United States Patent [19]

Arasi, Jr.

[11] Patent Number: 4,652,072

[45] Date of Patent: Mar. 24, 1987

[54] CABLE-CONNECTOR ASSEMBLY

[75] Inventor: Louis A. Arasi, Jr., Eustis, Fla.

[73] Assignee: Wire Tech Incorporated, Tavares, Fla.

[21] Appl. No.: 856,497

[22] Filed: Apr. 28, 1986

[51] Int. Cl.[4] ..... H01R 13/58

[52] U.S. Cl. ..... 339/103 R

[58] Field of Search ..... 339/103, 107, 101; 24/179

[56] References Cited

U.S. PATENT DOCUMENTS 3,732,526 5/1973 Punaro ..... 339/101

4,592,576 6/1986 Proctor et al. ..... 24/279 X

*Primary Examiner*—Eugene F. Desmond

*Attorney, Agent, or Firm*—Duckworth, Allen & Dyer

[57] ABSTRACT

A cable-connector assembly adapted to be removably secured to a housing of a multiple connection device. The assembly has a cable with at least one end, and the cable includes a plurality of insulated conductors encased therein and extending beyond the at least one end of the cable for electrical connection within the housing of the multiple connection device, respectively. A connector is releasably secured in stress relief association with a part of the cable at least generally adjacent the at least one end thereof. The connector includes a sleeve disposed about the cable part and yieldable at least in part for releasable gripping engagement with the cable part, and means is associated with the sleeve for exerting a force thereon to effect the yielding of the at least part of the sleeve means into the releasable gripping engagement thereof with the cable part thereby to releasably secure the connector in the stress relief association thereof with the cable part.

5 Claims, 3 Drawing Figures

CABLE-CONNECTOR ASSEMBLY

Field of the Invention

This invention relates in general to electrical connection devices and in particular to a cable connector assembly adapted to be removably secured to a housing of a multiple connection device.

Background of the Invention

In the past, various different types of cable-connector assemblies have been provided for securement, i.e., either removable securement or fixed securement, with a housing of a multiple connector device. In these past cable-connector assemblies, an end of a cable was passed through an opening therefor in a connector which was either removably secured or fixedly secured to the housing of the multiple connection device. A plurality of insulated conductors encased by the cable extended beyond the end of the cable into a chamber in the housing of the multiple connection device which was, of course, provided with an opening therein to receive the insulated conductors, and the insulated conductors were inserted for electrical connection into a plurality of receptacles provided therefor within the housing of the multiple connection device. In at least some of the past cable-connector assemblies, the connector was disposed in gripping engagement with the cable passed therethrough, and in this manner when the connector was secured to the housing of the multiple connection device, the cable could not be readily displaced from the housing so as to interrupt the aforementioned electric connections of the insulated conductors of the cable. The gripping engagement between the connector and cable of the past cable-connector assemblies is believed to have extended over a relatively short distance, and it is believed that repeated flexing of the cable generally at the end thereof received in the connector may have stressed the insulated conductors resulting in the interruption or failure of their electrical connection within the housing of the multiple connection device.

One of the disadvantageous or undesirable features of the past cable-connector assemblies is believed to be that the length of the gripping engagement between the connector and cable was not great enough to provide adequate stress relief for the cable. It is also believed that another of the disadvantageous or undesirable features of such past cableconnector assemblies was that the connector thereof could not be conveniently disassembled from the cable and reassembled thereto in the field in the event it was necessary to repair or replace either the cable or such other past connectors.

U.S. Pat. No. 4,306,760 issued Dec. 22, 1981 shows a cable-connector assembly having a sleeve of elastomeric material heat shrunk into place between a cable and a housing extension of a multiple connection device in which the cable is received thereby to provide at least some stress relief for maintaining the electrical connection integrity of the insulated conductors of the cable within the housing of the multiple connection device. In the event it was necessary to replace or repair this patented cable-connector assembly in the field, the heat shrunk sleeve was replaced by wrapping the housing extension and cable with elastomeric pressure sensitive electrical tape, or in the alternative, another heat shrinkable sleeve was loosely provided on the cable for subsequent heat shrinking engagement about the housing extension and cable upon the removal of the original sleeve. While this patented cable-connector assembly may have had some salient features, it is believed that one of the disadvantageous or undesirable features thereof was that the replacement of the original heat shrunk sleeve with electomeric pressure sensitive electrical tape during repair in the field effected a mere temporary repair. Further, with respect to the alternative heat shrinkable sleeve of this patented cable-connector assembly, it is believed that a means for creating the heat necessary to replace the original heat shrunk sleeve with such alternative heat shrinkable sleeve may not have been readily available, if available at all, during a field repair. Further, it is believed that both the heat shrinkable sleeve and tape fail to provide secure retention of the cable due to the inherent flexibility of the sleeve or tape.

SUMMARY OF THE INVENTION

Among the several objects of the present invention may be noted the provision of an improved cable-connector assembly which overcomes at least some of the disadvantageous or undesirable features discussed above, as well as others, with respect to the prior art; the provision of such improved cable-connector assembly which provides adequate stress relief for a plurality of insulated conductors of a cable received in a connector of such assembly thereby to maintain electrical connection integrity of the insulated conductors within a housing of a multiple connection device therefor; the provision of such improved cable-connector assembly in which the length of the gripping engagement of the connector about the cable is great enough to provide the aforementioned adequate stress relief; the provision of such improved cable-connector assembly which may be repeatedly and conveniently disassembled and reassembled to effect field repairs thereof; the provision of such improved cable-connector assembly which obviates the need of replacement parts therefor during a field repair thereof; and the provision of such improved cable-connector assembly in which the component parts thereof are simple in design, economically manufactured and easily assembled. These as well as other objects and advantageous features of the present invention will be in part apparent and in part pointed out hereinafter.

In general, a cable-connector assembly in one form of the invention is adapted to be removably secured to a housing of a multiple connection device. The assembly has a cable with at least one end, and the cable includes a plurality of insulated conductor means encased within the cable and extending beyond the at least one end thereof for electrical connection within the housing of the multiple connection device, respectively. A connector is releasably secured in stress relief association with a part of the cable at least adjacent the at least one end thereof. The connector has sleeve means disposed about the cable part and yieldable at least in part for releasable gripping engagement with the cable part, and means is associated with the sleeve means for exerting a force thereon to effect the yielding of the at least part of the sleeve means into the releasable gripping engagement thereof with the cable part thereby to releasably secure the connector in the stress relief association thereof with the cable part.

BRIEF DESCRIPTION OF THE DRAWINGS

Corresponding reference characters refer to corresponding parts throughout the several views of the drawings.

The exemplifications set out herein illustrate the preferred embodiment of the present invention in one form thereof, and such exemplifications are not to be construed in any manner as limiting either the scope of the invention or the disclosure thereof.

DETAILED DESCRIPTION OF THE PREFERRED EMBODIMENT

Figure 1:
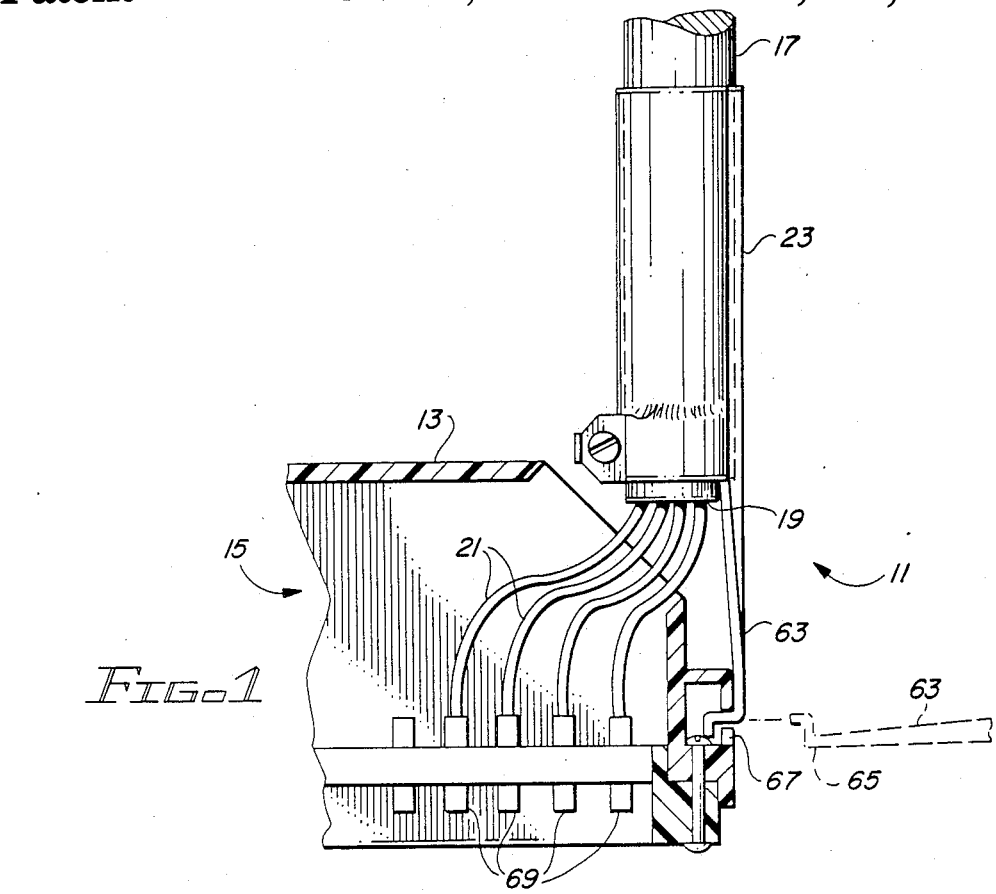
FIG. 1 is a partial sectional view illustrating a cable-connector assembly in one form of the invention releasably secured to a housing of a multiple connection device with a plurality of insulated conductors extending from the cable for electrical connection within the housing, respectively.
Figure 2:
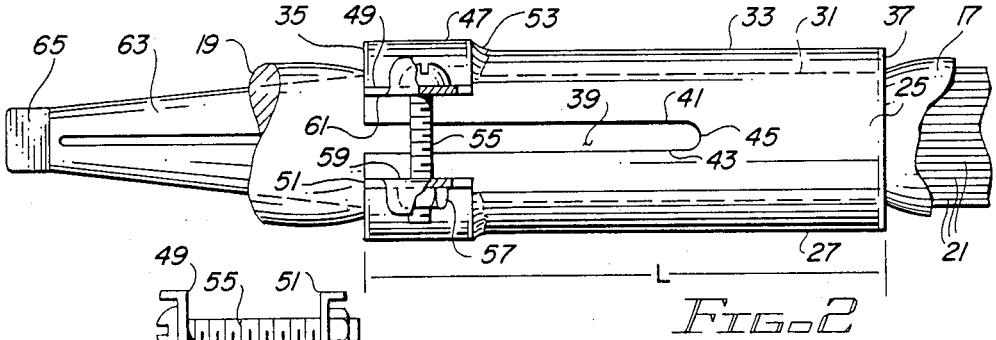
FIG. 2 is a top elevational view of the cable-connector assembly of FIG. 1 with the cable-connector assembly disassociated from the multiple connection device.
Figure 3:
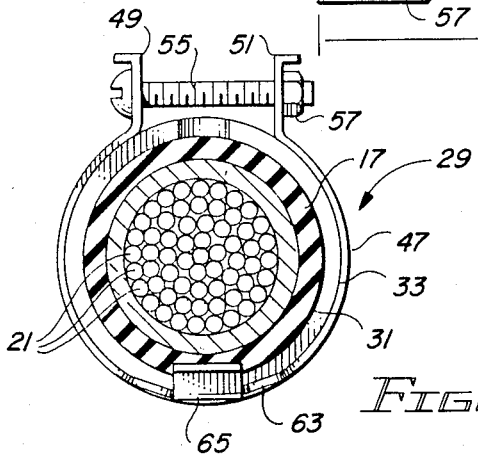
FIG. 3 is a left end elevational view showing the cable connector assembly of FIG. 2 partially in cross-section.

With reference now to the drawings in general, there is shown a cable-connector assembly 11 in one form of the invention adapted to be removably secured to a housing 13 of a multiple connection device 15 (FIG. 1). A cable 17 has at least one end 19 and includes a plurality of insulated conductors or conductor means 21 encased within the cable and extending beyond cable end 19 for electrical connection within housing 13 of multiple connection device 15 (FIG. 1). A connector 23 is releasably secured in stress relief association with a part 25 of the cable at least adjacent end 19 of the cable (FIGS. 1–3). Connector 23 includes sleeve means, such as a generally elongate tubular sleeve 27 or the like for instance, disposed about cable part 25 and yieldable at least in part for releasable gripping engagement with the cable part, and means, such as a clamp or clamping means 29 or the like for instance, is associated with the sleeve for exerting a force thereon to effect the yielding of the sleeve into the releasable gripping engagement thereof with the cable part thereby to releasably secure connector 23 in the stress relief association thereof with the cable part (FIGS. 2 and 3).

More particularly and with specific reference to FIGS. 1–3, sleeve 27 of connector 23 may be formed of any suitable material having the required structural strength and resilient characteristics, such as a stainless steel or the like for instance, and the sleeve is provided with generally radially spaced apart inner and outer circumferential surfaces 31, 33 with the inner circumferential surface being sized to receive cable part 25 at least in a slip fit or slide fit relation therein when the cable part is inserted into the sleeve. A pair of generally opposite ends or end portions 35, 37 are provided on sleeve 27 to define a preselected axial length L thereof, and the opposite end portions are generally radially interposed between inner and outer circumferential surfaces 31, 33 of the sleeve, respectively. It may be noted that the preselected axial length L of sleeve 27 is great enough to provide adequate stress relief association of connector 23 with cable part 25 when the sleeve is in the releasable gripping engagement thereof with the cable part, as discussed in greater detail hereinafter.

A generally elongate slot or slot means 39 is provided in sleeve 27 intersecting with opposite end portion 35 thereof, and the slot is operable generally for effecting the aforementioned yielding of at least a part of the sleeve extending along or adjacent the slot in response to the force exerted on the sleeve by clamp 29. Slot 39 extends at least generally axially along a major portion of the preselected axial length L of sleeve 27, and the slot includes a pair of generally spaced apart opposed sidewalls 41, 43 which intersect with opposite end 35 of the sleeve and also with inner and outer circumferential surfaces 31, 33 thereof respectively. An end wall 45 is provided on sleeve 27 within slot 39 between opposite side walls 41, 43 thereof and intersecting with inner and outer circumferential surfaces 31, 33 of the sleeve, respectively, and the end wall is arranged so as to face generally toward opposite end portion 35 of the sleeve. Thus, it may be noted that the parts of sleeve 27 extending generally along opposed side walls 41, 43 of slot 39 between opposite end 35 of the sleeve and end wall 45 of the slot may resiliently yield or be deflected in response to the force exerted on the sleeve by clamp 29 thereby to move the opposed side walls generally toward each other. Of course, upon the above discussed deflection of sleeve 27 effecting the displacement of opposed side walls 41, 43 of slot 39 toward each other, at least the part of inner circumferential surface 31 defined generally between opposite end portion 35 of the sleeve and end wall 45 of the slot is urged toward the aforementioned releasable gripping engagement thereof about cable part 25 thereby to effect the releasable securement of connector 23 in the stress relief association thereof with the cable part. Of course, the axial length of slot 39, the magnitude of the force exerted by clamp 29 on sleeve 27, and the lever length or location of the force from end wall 45 of the slot is determinative of the deflection of opposed side walls 41, 43 of the slot toward each other which, of course, defines the intensity of the releasable gripping engagement between the sleeve and cable part 25. While slot 39 is illustrated herein as extending along a major portion of the preselected length L of sleeve 27 for purposes of disclosure, it is contemplated that the slot may extend only half or less than half of the preselected length of the sleeve within the scope of the invention so as to meet at least some of the objects thereof.

Clamp 29 may be formed from a strip of any suitable metallic material having the desired structure strength and resilient characteristics, such as a stainlesss steel or the like for instance. Clamp 29 has an intermediate section or portion 47 interposed between a pair of generally opposite end portions or end sections 49, 51 thereof, and the intermediate section of the clamp extends in part generally circumferentially about a major portion of outer circumferential surface 33 of sleeve 27. Opposite end sections 49, 51 of clamp 29 extend generally in opposed spaced apart relation from each other and generally in spaced apart relation with opposed side walls 41, 43 of slot 29 along at least a part thereof, and the opposed end sections also extend generally outwardly beyond outer circumferential surface 33 of sleeve 27. It may be noted that clamp 29 is disposed at least generally adjacent opposite end portion 35 of sleeve 27 thereby to maximize the aforementioned lever distance from end wall 45 of slot 39 at which the force is exerted on the sleeve by the clamp, and a weldment 53 is provided between at least a part of intermediate section 47 of the clamp and outer circumferential surface 33 of the sleeve thereby to interconnect the clamp and the sleeve and maintain the clamp against axial or rotational displacement with respect to the sleeve. While clamp 29 is illustrated herein as being disposed in a preselected position therefore generally at opposite end 35 of sleeve 27, it is contemplated that the clamp may be disposed in other clamping positions therefor along the sleeve within the scope of the invention so as to meet at least some of the objects thereof. Force exerting means, such as a threaded machine screw and nut assembly 55, 57 or the like for instance, is interposed between opposite end sections 49, 51 of clamp 29 for releasably establishing the force exerted by the clamp on sleeve 29, and screw 55 extends through a pair of generally aligned openings 59, 61 in the opposite end sections of the clamp. Thus, in response to the threaded engagement between screw 55 and nut 57, opposite end sections 49, 51 of clamp 29 are driven toward each other thereby to tighten the clamp about the outer circumferential surface 33 of sleeve 27 to exert the clamping force thereon and such threaded engagement may be effected by the use of a convenient tool, such as a screw driver or the like for instance.

It may be noted that the intensity of the releasable gripping engagement of sleeve 27 about cable part 25 may be easily and conveniently adjusted by merely adjusting the threaded engagement of screw 55 with nut 57, and it may also be noted that the aforementioned ease and convenience of adjusting the releasable gripping engagement between the sleeve and the cable part therein facilitates the disassembly and reassembly of cable-connected assembly 11 in the event of the occurrence or necessity of a field repair thereof. In addition, it may be further noted that the releasable gripping engagement of sleeve 27 with cable part 25 is effective to obviate displacement of cable 17 from connector 23 thereby to maintain the electrical connection integrity of insulated conductor 21 within housing 13 of multiple connection device 13. Still further, it may should also be noted that the support afforded cable part 25 throughout the preselected length L of connector 23 as well as the releasable gripping engagement of sleeve 27 about the cable part is effective to provide the stress relief necessary for cable 17 in order to obviate over-stressing the insulated conductors 21 and any resulting interruption or failure of their electrical connection within housing 13 of multiple connection device 15 in the event of the occurrence of repeated flexing of cable 17.

Means, such as an extension or finger 63 or the like for instance, is integrally formed with clamp 29 and extends therefrom beyond opposite end 35 of sleeve 27 for releasable engagement or removable securement to housing 13 of multiple connection device 15, as best seen in FIG. 1. Extension 63 has a generally L-shaped flange 65 on the free end thereof which is received in removable securement with a slot 67 provided therefor in housing 13 of multiple connection device 15. Flange 65 may be positioned adjacent housing slot 67, as illustrated in dotted outline in FIG. 1, and then passed into the housing slot. When extension 63 and flange 65 are revolved toward the full outline position thereof in FIG. 1, the flange is interlocked in engagement with housing 13 about slot 67 therein thereby to effect the releasable securement of cable-connector assembly 11 with the housing of multiple connection device 15. Of course, when cable-connector assembly 11 is releasably secured to housing 13 of multiple connection device 15, as discussed, insulated conductors 21 extending from end 19 of cable 17 are received for electrical connection in a plurality of receptacles 69 provided therefor within the housing. While the association of flange 65 and housing slot 67 is shown and described herein to illustrate the removable securement of cable-connector assembly 11 with housing 13 of multiple connection device 15 for the purpose of disclosure, it is contemplated that various other constructions or schemes may be employed to effect the removable securement of the cable-connector assembly and the housing of the multiple connection device. Cable 25 of various sizes and various different models of multiple connection devices, such as multiple connection device 15 for instance, are available from ITT Cannon, 666 E. Dyer Road, Santa Ana, Calif. 92702.

From the foregoing, it is now apparent that an improved and novel cable-connector assembly 11 has been presented meeting the objects set out herebefore, as well as others, and it is contemplated that changes as to the precise arrangements, shapes, details and connections of the component parts of such cable-connector assembly may be made by those having ordinary skill in the art without departing from the spirit of the invention or from the scope thereof as set out in the claims which follow.

I claim:

1. A cable-connector assembly to be removably secured to a housing of a multiple connection device, the cable-connector assembly comprising:

a cable having at least one end and including a plurality of insulated conductor means encased within said cable and extending beyond said at least one end thereof for electrical connection within the housing of the multiple connection device, respectively;

a connector releasably secured in stress relief association with said cable and including a generally elongate rigid tubular sleeve disposed at least in part in releasable gripping engagement about a part of said cable at least generally adjacent said at least one end thereof, a pair of generally opposite end portions on said sleeve defining the axial length thereof, respectively, slot means in said sleeve intersecting with one of said opposite end portions thereof and operable generally for resiliently yielding at least a part of said sleeve adjacent said slot means, clamping means extending in part generally circumferentially about said sleeve at least generally adjacent said one opposite end portion thereof and operable generally for exerting a force on said sleeve to effect the yielding of said at least part thereof adjacent said slot means thereby to urge said at least part of said sleeve toward the releasable gripping engagement thereof about said cable part so as to releasably secure said connector in the stress relief association thereof with said cable; and means extending from said clamping means beyond said one opposite end portion of said sleeve for removable securement to the housing of the multiple connection device.

2. A cable-connector assembly adapted to be removably secured to a housing of a multiple connection device, the cable-connector assembly comprising:

a generally elongate cable having at least one end and including a plurality of insulated conductors encased within said cable and extending from said cable beyond said at least one end thereof so as to be electrically connected within the housing of the multiple connection device, respectively; and a connector releasably secured in stress relief association with said cable at least when said insulated conductors are electrically connected within the housing of the multiple connection device, said connector including a generally elongate tubular sleeve formed of a metallic material and having generally radially spaced apart inner and outer circumferential surfaces with said inner circumferential surface being arranged at least in part in releasable gripping engagement about said cable at least generally adjacent said at least one end thereof, a pair of generally opposite end portions on said sleeve defining the axial length thereof and interposed between said inner and outer circumferential surfaces of said sleeve, respectively, a generally elongate slot in said sleeve extending at least generally axially along at least a major portion of the axial length thereof and including a pair of generally opposed side walls intersecting with one of said opposite end portions of said sleeve and said inner and outer circumferential surfaces thereof, respectively, and an end wall interposed between said opposed side walls so as to face generally toward said one opposite end portion of said sleeve and intersecting between said inner and outer circumferential surfaces thereof, respectively, a clamp secured to said outer circumferential surface of said sleeve at least generally adjacent said one opposite end portion thereof and extending generally circumferentially about a major portion of said outer circumferential surface, a pair of generally opposite free end sections on said clamp extending generally in opposed spaced apart relation from each other along at least a part of said opposed sidewalls of said slot in spaced apart relation therefrom and generally outwardly beyond said circumferential surface, respectively, means interconnected between said opposite end sections of said clamp for applying a force thereon urging said opposite end sections in the opposed spaced apart relation thereof generally toward each other, said sleeve being deflected along at least a part of said slot in response to the force applied onto said opposite free end sections of said clamp so as to displace said opposed side walls of said slot generally toward each other generally about said end wall of said slot thereby to urge said at least part of said inner circumferential surface toward the releasable gripping engagement thereof about said cable so as to effect the releasable securement of said connector in the stress relief association thereof with said cable, and means integral with said clamp and extending therefrom beyond said one opposite end portion of said sleeve for removable securement with the housing the multiple connection device at least when said connector is releasably secured in the stress relief association thereof with said cable.

3. A cable-connector assembly adapted to be removably secured to a housing of a multiple connection device, the cable-connector assembly comprising:

a cable having at least one end and including a plurality of insulated conductor means encased within said cable and extending beyond said at least one end thereof for electrical connection within the housing of the multiple connection device, respectively;

a connector releasably secured in stress relief association with a part of said cable at least adjacent said at least one end thereof and including sleeve means disposed about said cable part and yieldable at least in part for releasable gripping engagement with said cable part, and means associated with said sleeve means for exerting a force thereon to effect the yielding of the at least part of said sleeve means into the releasable gripping engagement thereof with said cable part thereby to releasably secure said connector in the stress relief association thereof with said cable part; and means on said force exerting means and extending therefrom beyond said sleeve means for removable securement to the housing of the multiple connection device.

4. A cable connector assembly adapted to be removably secured to a housing of a multiple connection device and adapted to secure a cable having at least one end, which cables includes a plurality of insulated conductor wires encased within the cable and extending beyond at least one end thereof for electrical connection with the housing of the multiple connection device, the cable connector assembly comprising:

a connector adapted to be releasably secured in stress relief association with a part of the cable at least adjacent at least one end of the cable, said connector including sleeve means disposed about the cable and yieldable at least in part for releasable gripping engagement with the cable, said connector further including means associated with said sleeve means for exerting a force thereon to effect the yielding of the at least part of said sleeve means into the releasable gripping engagement thereof with the cable thereby to releasably secure said connector in the stress relief association thereof with the cable, said sleeve means including a pair of opposite end portions and slot means in said sleeve means intersecting with one of said opposite end portions thereof and operable generally for effecting the yielding of said at least part of said sleeve means in response to the force exerted on said sleeve means by said force exerting means, said force exerting means including a clamp extending in part circumferentially about said sleeve means and adjacent one opposite end portion thereof, said clamp having a pair of opposite end sections arranged generally in opposed space apart relation, said force exerting means further comprising connecting means interconnected between said opposite end sections of said clamp and operable generally for releasably establishing the force exerted by said clamp on said sleeve means; and means on said force exerting means and extending therefrom beyond said sleeve means for removable securement to the housing of the multiple connection device.

5. A cable-connector assembly adapted to be removably secured to a housing of a multiple connection device and adapted to secure a cable having at least one end, which cable includes a plurality of insulated conductor wires encased within the cable and extending beyond at least one end thereof for electrical connection within the housing of the multiple connection device, the cable-connector assembly comprising:

a connector adapted to be releasably secured in stress relief association with the cable and including a generally elongate rigid metallic tubular sleeve adapted to be disposed at least in part in releasable gripping engagement about a part of the cable at least generally adjacent at least one end of the cable, a pair of generally opposite end portions on said sleeve defining the axial length thereof, respectively, slot means in said sleeve intersecting with one of said opposite end portions thereof and operable generally for resiliently yielding at least a part of said sleeve adjacent said slot means, clamping means extending in part generally circumferentially about said sleeve at least generally adjacent said one opposite end portion thereof and operable generally for exerting a force on said sleeve to effect the yielding of said at least part thereof adjacent said slot means thereby to urge said at least part of said sleeve toward the releasable gripping engagement thereof about the cable so as to releasably secure said connector in the stress relief association thereof with the cable; and means on said force exerting means and extending therefrom beyond said sleeve means for removable securement to the housing of the multiple connection device.

* * * * *